US006816118B2

(12) United States Patent
Kingsley et al.

(10) Patent No.: US 6,816,118 B2
(45) Date of Patent: Nov. 9, 2004

(54) MULTI-SEGMENTED DIELECTRIC RESONATOR ANTENNA

(75) Inventors: Simon P. Kingsley, Sheffield (GB); Steven G O'Keefe, Chambers Flat (AU)

(73) Assignee: Antenova Limited (GB)

( * ) Notice: Subject to any disclaimer, the term of this patent is extended or adjusted under 35 U.S.C. 154(b) by 167 days.

(21) Appl. No.: 10/221,396

(22) PCT Filed: Mar. 2, 2001

(86) PCT No.: PCT/GB01/00929

§ 371 (c)(1),
(2), (4) Date: Dec. 19, 2002

(87) PCT Pub. No.: WO01/69721

PCT Pub. Date: Sep. 20, 2001

(65) Prior Publication Data

US 2003/0184478 A1 Oct. 2, 2003

(30) Foreign Application Priority Data

Mar. 11, 2000 (GB) ..... 0005766

(51) Int. Cl.[7] ..... H01Q 1/38

(52) U.S. Cl. ..... 343/700 MS; 343/873; 342/368

(58) Field of Search ..... 343/700 MS, 873, 343/753, 754; 342/368, 371, 372; 333/219.1, 221.1, 202

(56) References Cited

U.S. PATENT DOCUMENTS

| | | | | |
|---|---|---|---|---|
| 5,111,210 A | | 5/1992 | Morse | 342/455 |
| 5,952,972 A | * | 9/1999 | Ittipiboon et al. | 343/700 MS |
| 6,452,565 B1 | * | 9/2002 | Kingsley et al. | 343/873 |

FOREIGN PATENT DOCUMENTS

| | | |
|---|---|---|
| EP | 0877 443 | 11/1998 |
| GB | 2 355 855 | 5/2001 |
| WO | WO 00/50920 | 8/2000 |

OTHER PUBLICATIONS

Ittipiboon et al.; "Aperture fed rectangular and triangular dielectric resonators for use as magnetic dipole antennas"; *Electronics Letters*; 29:23, (1993) 2 pgs.

(List continued on next page.)

*Primary Examiner*—Hoang V. Nguyen
(74) *Attorney, Agent, or Firm*—Sheridan Ross P.C.

(57) ABSTRACT

A radiating antenna capable of generating or receiving radiation using a plurality of dielectric resonator segments disposed in a circular array is disclosed. The purpose of using multiple dielectric resonator segments within a single antenna system is to produce several beams each having a "boresight" (that is, a direction of maximum radiation on transmit, or a direction of maximum sensitivity on receive) in a different direction. Several such beams may be excited simultaneously to form a new beam in any arbitrary direction. The new beam may be incrementally or continuously steerable and may be steered through a complete 360 degree circle. When two segments are excited simultaneously, the antenna may have a narrower main lobe and/or a smaller backlobe than for a single segment alone. When receiving radio signals, electronic processing of such multiple beams may be used to find the direction of those signals, thus forming the basis of a radio direction finding device. Further, by forming a transmitting beam or resolving a receiving beam in the direction of the incoming radio signal, a "smart" or "intelligent" antenna may be constructed. Beamsteering and smart antenna technology may also be used to steer a sharp null in a particular direction to avoid transmitting there or to avoid receiving interfering signals from that direction. The dielectric resonator segments are mounted on a ground plane, are substantially cylindrical or trapezoidal segments in shape, and are fed by internal probes or external ground plane apertures.

36 Claims, 5 Drawing Sheets

OTHER PUBLICATIONS

Kingsley et al.; "Beam steering and monopulse processing of probe–fed dielectric resonator antennas"; *IEE Proc.–Radar, Sonar Navig.*: 146:3, (Jun. 1999) pps. 121–125.

Mongia et al.; "Dielectric Resonator Antennas–A Review and General Design Relations for Resonant Frequency and Bandwidth"; *Int'l. Journal of Microwave and Millimeter–Wave Computer–Aided Engineering*; 4:3, (1994) pps. 230–247.

Petosa et al.; "Low Profile Phased Array of dielectric Resonator Antennas"; *IEEE*; (1996) pps. 182–185.

Petosa et al.; "Microstrip–fed array of multisegment dielectric resonator antennas"; *IEE Proc.–Microw.Antennas Propag.*; 144:6, (Dec. 1997) pps. 472–476.

Tam et al.; "Compact Circular Sector and Annular Sector Dielectric Resonator Antennas"; *IEEE Transactions on Antennas and Propagation*; 47:5, (May 1999) pps. 837–842.

http://www3.elec.mg.edu.au/electromag/antenna1/ant1_abs.html; 2 pgs.

Drossos et al.; "Two–element endfire dielectric resonator antenna array": Electronic Letters; 32:7, (Mar. 28, 1996), pps. 618–619.

Cooper et al.; "Investigation of Dielectric Resonator Antennas for L–Band Communications"; *ANTEM* (1996), pps. 167–170.

Fan et al.; "Experimental Investigation of Multi–Element Dielectric Resonator Antennas"; *IEEE* (1996); pps. 2034–2037.

Junker et al.; "Multiport Network Description and Radiation Characteristics of Coupled Dielectric Resonator Antennas"; *IEEE Transactions on Antennas and Propagation*; 46:3, (Mar. 1998) pps. 425–433.

* cited by examiner

Inner Probe No Extension

Outer Probe No Extension

Inner Probe With Extension

Outer Probe With Extension

MULTI-SEGMENTED DIELECTRIC RESONATOR ANTENNA

The present invention relates to dielectric resonator antennas (DRAs) composed of several adjacent segments, which may be excited simultaneously to provide steerable receive and transmit beams and very low backlobes.

Since the first systematic study of dielectric resonator antennas (DRAs) in 1983 [LONG, S. A., McALLISTER, M. W., and SHEN, L. C.: "The Resonant Cylindrical Dielectric Cavity Antenna", IEEE Transactions on Antennas and Propagation, AP-31, 1983, pp 406–412], interest has grown in their radiation patterns because of their high radiation efficiency, good match to most commonly used transmission lines and small physical size [MONGIA, R. K. and BHARTIA, P.: "Dielectric Resonator Antennas—A Review and General Design Relations for Resonant Frequency and Bandwidth", International Journal of Microwave and Millimetre-Wave Computer-Aided Engineering, 1994, 4, (3), pp 230–247].

The majority of configurations reported to date have used a slab of dielectric material mounted on a ground plane excited by either an aperture feed in the ground plane [ITTIPIBOON, A., MONGIA, R. K., ANTAR, Y. M. M., BHARTIA, P. and CUHACI, M: "Aperture Fed Rectangular and Triangular Dielectric Resonators for use as Magnetic Dipole Antennas", Electronics Letters, 1993, 29, (23), pp 2001–2002] or by a probe inserted into the dielectric material [McALLISTER, M. W., LONG, S. A. and CONWAY G. L.: "Rectangular Dielectric Resonator Antenna", Electronics Letters, 1983, 19, (6), pp 218–219]. Direct excitation by transmission lines has also been reported by some authors [KRANENBURG, R. A. and LONG, S. A.: "Microstrip Transmission Line Excitation of Dielectric Resonator Antennas", Electronics Letters, 1994, 24, (18), pp 1156–1157].

Further analysis of steerable-beam DRAs is to be found in the present applicant's co-pending U.S. patent application Ser. No. 09/431,548, from which the present application claims priority and the disclosure of which is incorporated into the present application by reference.

Two of the most commonly described geometries are cylindrical and rectangular dielectric slabs. Several publications describe how these may be bisected through an image plane by a conducting sheet [TAM, M. T. K. and MURCH, R. D.: "Half volume dielectric resonator antenna designs", Electron. Lett., 1997, 33, (23), pp. 1914–1916; MONGIA, R. K.: 'Half-split dielectric resonator placed on metallic plane for antenna applications'. Electron. Lett., 1989, 25, (7), pp 462–464]. To the applicant's knowledge, only one publication describes antennas made from segments smaller than a half volume [TAM, M. T. K. and Murch, R. D.: "Compact Circular Sector and Annular Sector Dielectric Resonator Antennas", IEEE Transactions on Antennas and Propagation, AP-47, 1999, pp 837–842].

According to a first aspect of the present invention, there is provided a compound dielectric resonator antenna comprising a plurality of individual dielectric resonator antennas, each including a grounded substrate, a dielectric resonator element having side faces and associated with the rounded substrate, and a feeding mechanism for transferring energy into and from the dielectric resonator element, characterised in that the dielectric resonator elements are arranged such that at least one side face of each dielectric resonator element is adjacent to at least one side face of a neighbouring dielectric resonator element and in that the antenna further includes electronic circuitry provided to activate the dielectric resonator elements individually or in combination so as to produce at least one incrementally or continuously steerable beam, which may be steered through a predetermined angle.

According to a second aspect of the present invention, there is provided a compound dielectric resonator antenna comprising a plurality of individual dielectric resonator antennas, each including a dielectric resonator element having side faces, and a feeding mechanism for transferring energy into and from the dielectric resonator element by way of at least one dipole feed. characterised in that the dielectric resonator elements are arranged such that at least one side face of each dielectric resonator element is adjacent to at least one side face of a neighbouring dielectric resonator element and in that the antenna further includes electronic circuitry provided to activate the dielectric resonator elements individually or in combination so as to produce at least one incrementally or continuously steerable beam, which may be steered through a predetermined angle.

It is preferred that the adjacent side faces are substantially contiguous. in that they contact each other. Alternatively, small gaps may be present between the adjacent side faces, these gaps being filled with air or another dielectric material.

Advantageously, the adjacent side faces of at least one pair of neighbouring dielectric resonator elements are separated by an electrically conductive wall which contacts both adjacent side faces. Preferably, all adjacent side walls are separated by an electrically conductive wall.

The dielectric resonator elements may be disposed directly on, next to or under the grounded substrate, or a small gap may be provided between the elements and the grounded substrate. The gap may comprise an air gap, or may be filled with another dielectric material of solid, liquid or gaseous phase.

The present invention seeks to provide an antenna having several elements, each of which is a segmented DRA. These elements may be excited simultaneously in order to provide steerable receive and transmit beams, radio direction finding capabilities, intelligent (or 'smart') antenna capabilities, low radiation backlobes and narrower radiation main lobes. The present invention also seeks to provide a significant further reduction in the backlobes by using extensions to the conducting walls that define the sides or edges of the DRA elements. Low backlobes are of particular importance to the application of these antennas to mobile telephones. Furthermore, an original geometry for the elements is proposed.

In some embodiments, a 90 degree sector of a cylindrical or annular DRA is resonated in its fundamental $HEM_{21\delta}$ mode, but there are several other resonant modes that may be used with this and with other geometries. An example of another combination is a 60 degree sector and its associated fundamental $HEM_{31\delta}$ mode.

The preferred $HEM_{11\delta}$, $HEM_{21\delta}$ and $HEM_{31\delta}$ modes are hybrid electromagnetic resonance modes, radiating like a horizontal magnetic dipole, which give rise to a vertically polarised radiation pattern with a cosine or figure-of-eight shaped pattern.

It has been noted by the present applicants that the results described in the above reference apply equally to DRAs operating at any of a wide range of frequencies, for example from 1 MHz to 100,000 MHz and even higher for optical DRAs. The higher the frequency in question, the smaller the size of the DRA, but the general beam patterns achieved by the probe/aperture and segment combination geometries described hereinafter remain generally the same throughout any given frequency range. Operation at frequencies substantially below 1 MHz is also possible, using dielectric materials with a high dielectric constant.

Advantageously, the antenna and antenna system of the present invention are adapted to produce at least one incrementally or continuously steerable beam, which may be steered through a complete 360 degree circle.

Advantageously, there is additionally or alternatively provided electronic circuitry to combine the feeds to form sum and difference patterns to permit radio direction finding capability of up to 360 degrees.

The electronic circuitry may additionally or alternatively be adapted to combine the feeds to form amplitude and/or phase comparison radio direction finding capability of up to 360 degrees.

In a first preferred embodiment, radio direction finding and beamforming capability is a complete 360 degree circle, with the individual DRA elements being arranged in a generally circular configuration about a longitudinal axis with each element being flanked by two neighbouring elements. It is to be understood that the elements need not be shaped so as to have cross-sections which form sectors of a circle. Instead, the elements may have generally triangular or trapezoidal cross-sections, the main consideration being that the elements are shaped so as to fit together about a longitudinal axis with each element being flanked by two neighbouring elements.

In a second preferred embodiment, radio direction finding and beamforming capability is less than a complete circle using an array of elements disposed about a longitudinal axis which themselves amount to less than a circle, with all except the first and last elements of the array being flanked by two neighbouring elements.

In both first and second embodiments, it is preferred that all the elements making up the DRA have the same cross-section. This means that each element will behave in a similar manner to the others when excited, notwithstanding directional effects due to the relative orientations of the elements.

One method of electronically steering an antenna pattern is to have a number of existing beams and to switch between them. An alternative method is to combine them so as to achieve the desired beam direction. With DRAs, the antenna patterns are essentially cosine shaped and adding together two cosines slightly displaced in angle gives a third cosine pattern half way between the two. In this way, beam steering and direction finding may be achieved by combining fixed antenna patterns.

The advantage of direction finding is that the direction of a base station can be found (by a mobile phone for example) and the advantage of beam steering is that a beam can then be formed in the direction of the base station. These advantages combine to improve the transfer of power between a mobile phone and base station, thereby increasing communication quality and conserving battery life, and yet, simultaneously, reducing the transfer of power into the body of the person using the phone. An important finding by the present applicant is that a single element driven alone does not generally have a backlobe as small as, say, two elements driven simultaneously. The simultaneous use of at least two elements can confer a significant advantage in this respect.

An advantage of the geometry of the second preferred embodiment above and similar geometries, wherein the elements are not arranged in a complete circle, is that the backlobe generated by the antenna which irradiates nearby objects (such as the human head when using mobile phones) can, with some geometrical arrangements, be kept very low thereby much reducing the irradiation and resulting in improved safety.

A further advantage of the geometry of the second preferred embodiment and similar geometries, is that the main lobe generated by the antenna can be narrower when two elements are excited together than for either element separately.

A further reduction in the backlobe of a segmented DRA can be obtained by providing extensions to the conducting walls that define the edges of each element. Such devices can be simply planar extensions of the conducting walls, but they may also be curled, or deformed in other ways, so as to impede the electromagnetic wave trying to creep round the edge of the wall and so create (or contribute to) the backlobe of the antenna. This has been demonstrated by the present applicant using a half-cylinder DRA resonating at 58 MHz.

In a further embodiment of the present invention, there may additionally be provided at least one internal or external monopole antenna or any other antenna possessing a circularly symmetric pattern about a longitudinal axis, which is combined with at least one of the dielectric resonator antenna elements so as to cancel out backlobe fields or to resolve any front-to-back ambiguity which may occur with a dielectric resonator antenna having a cosine or figure-of-eight radiation pattern. The monopole or other circularly symmetrical antenna may be centrally disposed within the dielectric resonator element or may be mounted thereupon therebelow and is activatable by the electronic circuitry. In embodiments including an annular resonator with a hollow centre, the monopole or other circularly symmetrical antenna may be located within the hollow centre. A "virtual" monopole or other circularly symmetrical antenna may also be formed by an electrical or algorithmic combination of any of the actual feeds, preferably a symmetrical set of feeds.

With all the segment geometries described above, the feeds may take the form of conductive probes which are contained within or placed against the dielectric resonator elements, or a combination thereof, or may comprise aperture feeds provided in the grounded substrate. Aperture feeds are discontinuities (generally rectangular in shape) in the grounded substrate underneath the dielectric material and are generally excited by passing a microstrip transmission line beneath them. The microstrip transmission line is usually printed on the underside of the substrate. Where the feeds take the form of probes, these may be generally elongate in form. Examples of useful probes include thin cylindrical wires which are generally parallel to a longitudinal axis of the dielectric resonator. Other probe shapes that might be used (and have been tested) include fat cylinders, non-circular cross sections, thin generally vertical plates and even thin generally vertical wires with conducting "hats" on top (like toadstools). Probes may also comprise metallised strips placed within or against the dielectric, or a combination thereof. In general, any conducting element within or against the dielectric resonator, or a combination thereof, will excite resonance if positioned, sized and fed correctly. The different probe shapes give rise to different bandwidths of resonance and may be disposed in various positions and orientations (at different distances along a radius from the centre and at different angles from the centre, as viewed from above) within or against the dielectric resonator or a combination thereof, so as to suit particular circumstances. Furthermore, there may be provided probes within or against the dielectric resonator, or a combination thereof, which are not connected to the electronic circuitry but instead take a passive role in influencing the transmit/receive characteristics of the dynamic resonator antenna, for example, by way of induction.

Generally, where the feed comprises a monopole feed, then the appropriate dielectric resonator element must be associated with a rounded substrate, for example by being disposed thereupon or separated therefrom by a small air gap or a layer of another dielectric material. Alternatively, where the feed comprises a dipole feed, then no grounded substrate is required. Embodiments of the present invention may use monopole feeds to dielectric elements associated with a grounded substrate, and/or dipole feeds to dielectric elements not having an associated grounded substrate. Both types of feed may be used in the same compound antenna.

The dielectric resonator elements may be segments of a cylinder, having substantially radial conducting walls advantageously disposed generally parallel to the longitudinal axis.

Alternatively, the dielectric resonator elements may be of a generally trapezoidal cross-section, having conducting walls advantageously disposed generally parallel to the longitudinal axis.

The array of elements may be arranged so as to be with or without a hollow centre.

The dielectric resonator elements may have cross-sections other than segments of a circle or generally trapezoidal. What is important for achieving the greatest back-lobe reductions is that the array of elements has full or at least partial circular symmetry about the longitudinal axis.

The dielectric resonator antenna of the present invention may be operated with a plurality of transmitters or receivers, the terms here being used to denote respectively a device acting as a source of electronic signals for transmission by way of the antenna or a device acting to receive and process electronic signals communicated to the antenna by way of electromagnetic radiation. The number of transmitters and/or receivers may or may not be equal to the number of elements being excited. For example, a separate transmitter and/or receiver may be connected to each element (i.e. one per element), or a single transmitter and/or receiver to a single element (i.e. a single transmitter and/or receiver is switched between elements). In a further example, a single transmitter and/or receiver may be (simultaneously) connected to a plurality of elements. By continuously varying the feed power between the elements, the beam and/or directional sensitivity of the antenna may be continuously steered. A single transmitter and/or receiver may alternatively be connected to several non-adjacent elements. In yet another example, a single transmitter and/or receiver may be connected to several adjacent or non-adjacent elements in order to produce an increase in the generated or detected radiation pattern, or to allow the antenna to radiate or receive in several directions simultaneously.

The dielectric resonator elements may be formed of any suitable dielectric material, or a combination of different dielectric materials, having an overall positive dielectric constant k. In preferred embodiments, k is at least 10 and may be at least 50 or even at least 100. k may even be very large, e.g. greater than 1000, although available dielectric materials tend to limit such use to low frequencies. The dielectric material may include materials in liquid, solid or gaseous states, or any intermediate state. The dielectric material could be of lower dielectric constant than a surrounding material in which it is embedded.

By seeking to provide a dielectric resonator antenna capable of generating multiple beams, which can be selected separately or formed simultaneously and combined in different ways at will, embodiments of the present invention may provide the following advantages:

i) By choosing to drive different elements of a multi-element DRA, the antenna can be made to transmit or receive in one of a number of preselected directions (in azimuth, for example). By sequentially switching round the elements, the beam pattern can be made to rotate incrementally in angle. Such beam-steering has obvious applications for radio communications, radar and navigation systems.

ii) By combining two or more beams together, i.e. exciting two or more elements simultaneously, beams can be formed in any arbitrary azimuth direction, thus giving more precise control over the beamforming process.

iii) By electronically continuously varying the power division/combination between two beams, the resultant combination beam direction can be steered continuously.

iv) On receive only, the direction of arrival of an incoming radio signal can be found by comparing the amplitude of the signal on two or more beams, or by carrying out monopulse processing of the signal received on two beams. "Monopulse processing" refers to the process of forming sum and difference patterns from two beams so as to determine the direction of arrival of a signal from a distant radio source.

v) In a typical two-way communication system (such as a mobile telephone system) signals are received (by a handset) from a point radio source (such as a base station) and transmitted back to that source. Embodiments of the present invention may be used to find the direction of the source using iii) or iv) above and may then form an optimal beam in that direction using ii). An antenna capable of performing this type of operation is said to have as a "smart" or "intelligent" capabilities. The advantages of the improved antenna gain offered by smart antennas is that the signal-to-noise ratio is improved, communications quality is improved, less transmitter power may be used (which can, for example, help to reduce irradiation of any nearby human body) and battery life is conserved.

vi) Beamsteering and smart antenna technology may also be used to steer a sharp null in a particular direction to avoid transmitting there or to avoid receiving interfering signals from that direction.

For a better understanding of the present invention and to show how it may be carried into effect, reference shall now be made by way of example to the accompanying drawings, in which.

Figure 1:
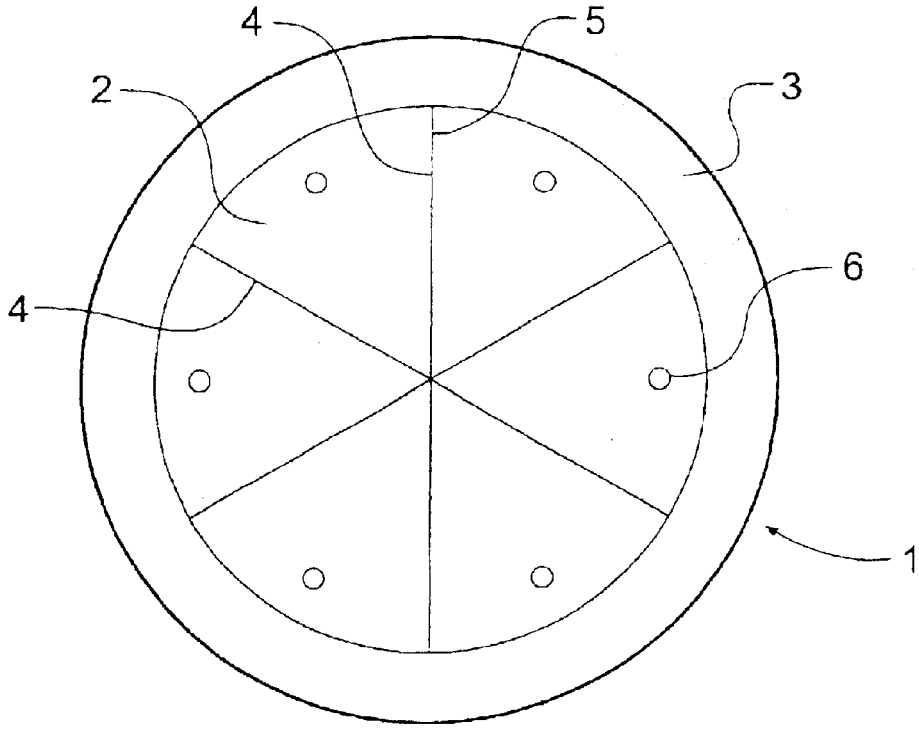
FIG. 1 shows a first embodiment of the present invention comprising a DRA constructed from six 60 degree sections of a cylinder.

FIG. 1 is a plan view of a multi-segmented DRA 1 formed of six dielectric resonator elements 2 shaped as 60 degree sectors of a cylinder and arranged in circular symmetry on a grounded base plane 3. Side faces 4 of the elements 2 are separated by conducting walls 5 made out of a metal. An elongate probe 6 is located in each element, the elongate probes 6 being generally parallel with a longitudinal axis of the DRA 1, as are the conducting walls 5. One or several probes 6 may be driven simultaneously to achieve direction finding (a receive-only function), beamsteering (on receive and/or transmit) and "smart" antenna properties.

Figure 2:
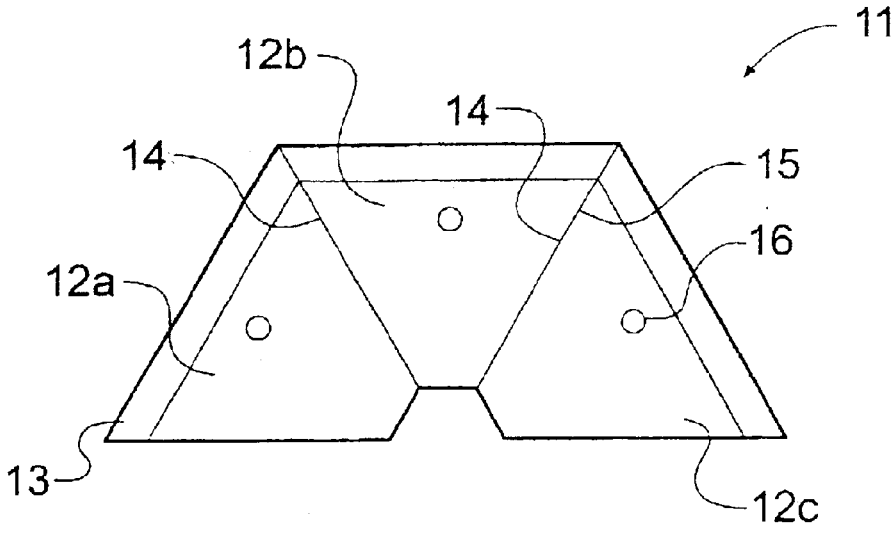
FIG. 2 shows a second embodiment of the present invention comprising a DRA constructed from three 60 degree trapezoidal elements.

FIG. 2 is a plan view of a multi-segmented DRA 11 formed of three dielectric resonator elements 12*a*, 12*b* and 12*c* shaped as elements with 60 degree trapezoidal cross-sections and arranged in partial circular symmetry on a grounded base plane 13. Side faces 14 of the elements 12*a*, 12*b* and 12*c* are separated by conducting walls 15 made out of a metal. An elongate probe 16 is located in each element, the elongate probes 16 being generally parallel with a longitudinal axis of the DRA 11, as are the conducting walls 15. One or several probes 16 may be driven simultaneously to achieve direction finding (a receive-only function), beamsteering (on receive and/or transmit) and "smart" antenna properties. Because the array of elements 12*a*, 12*b* and 12*c* forming the DRA 11 of FIG. 2 is less than a complete circle, radio direction finding and beamforming capability is correspondingly less than a complete circle.

Figure 3:
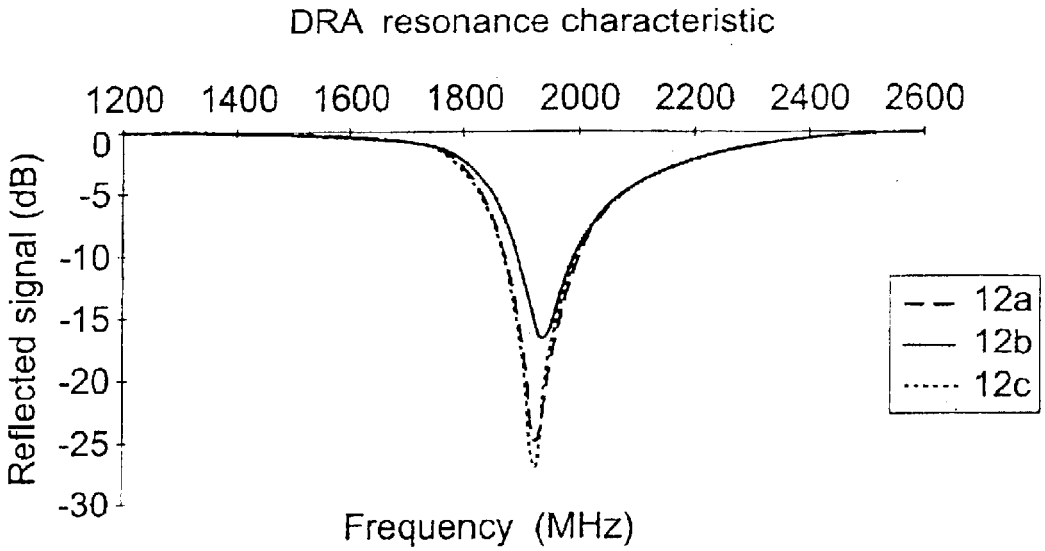
FIG. 3 shows the resonance characteristics for the DRA of FIG. 2.

FIG. 3 is a graph of frequency against $S_{11}$ reflected signal measurements for the DRA 11 of FIG. 2 when elements 12*a*, 12*b* and 12*c* are excited. It can be seen that all three elements 12*a*, 12*b* and 12*c* resonate at approximately 1950 MHz.

Figure 4:
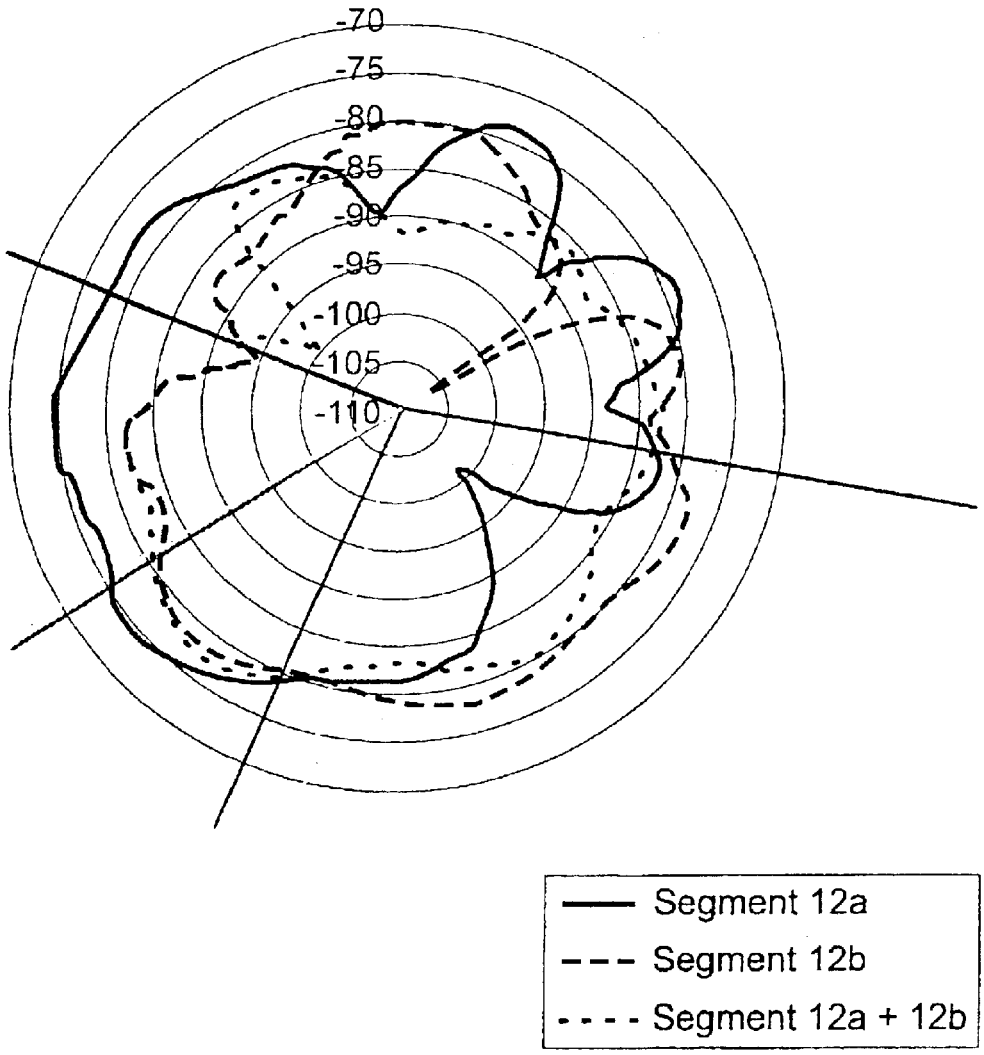
FIG. 4 shows the radiation patterns generated by the DRA of FIG. 2.

FIG. 4 shows the azimuth antenna radiation patterns generated by DRA elements 12*a*, 12*b* and 12*a*+12*b* driven together though a power splitter/combiner (not shown). The major circular lines represent 5 dB steps. It can firstly be seen that the 12*a*+12*b* beam has been steered to roughly half way between the 12*a* pattern and the 12*b* pattern, thus demonstrating electronic beam steering. Secondly, it can be seen that there is an improvement, i.e. reduction in the backlobe of the combined 12*a*+12*b* antenna. Thirdly it can be seen that the main lobe of the 12*a*+12*b* pattern is significantly narrower than the 12*a* and 12*b* patterns alone at the −3 dB points.

Figure 5:
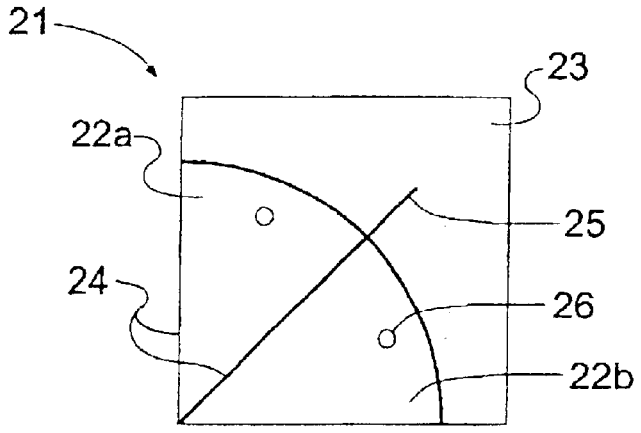
FIG. 5 shows a third embodiment of the present invention comprising a DRA constructed from two 45 degree quadrants of a cylinder.

FIG. 5 is a plan view of a multi-segmented DRA 21 formed of two dielectric resonator elements 22*a* and 22*b* shaped as 45 degree sectors of a cylinder and arranged in partial circular symmetry on a grounded base plane 23. Side faces 24 of the elements 22*a* and 22*b* are separated by conducting walls 25 made out of a metal. An elongate probe 26 is located in each element, the elongate probes 26 being generally parallel with a longitudinal axis of the DRA 21, as are the conducting walls 25.

Figure 6:
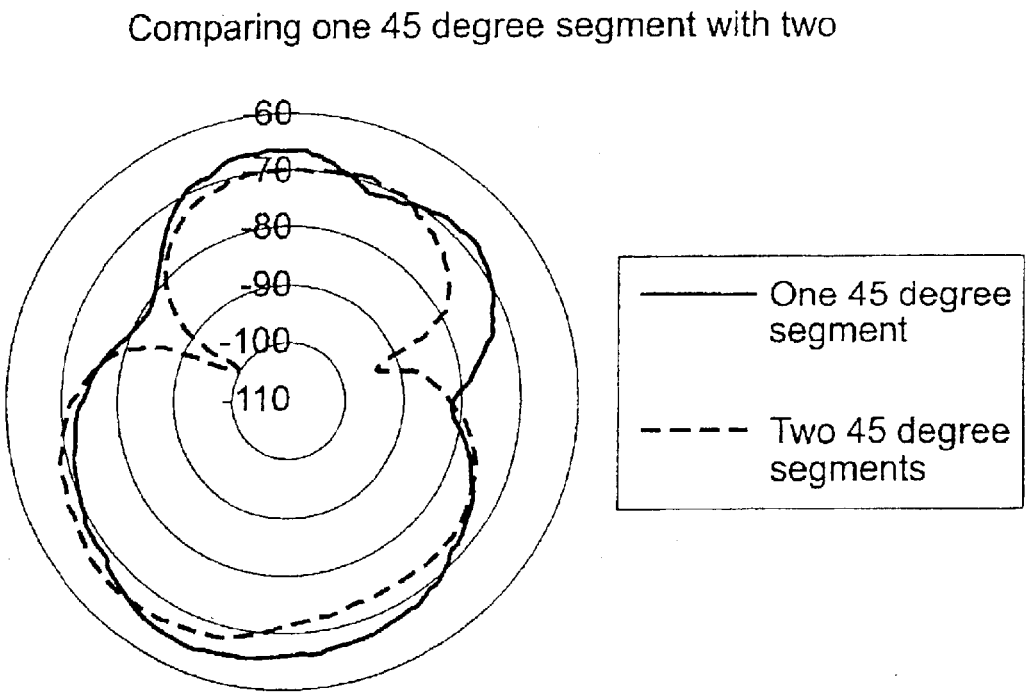
FIG. 6 shows the radiation patterns generated by the DRA of FIG. 5.

FIG. 6 shows the azimuth antenna radiation patterns generated by DRA elements 22*a* and 22*a*+22*b* driven together though a power splitter/combiner (not shown). The major circular lines represent 5 dB steps. As with the DRA of FIGS. 2 and 4, it can be seen that electronic beam steering and a reduction in the backlobe of the combined 22*a*+22*b* antenna are achieved.

Figure 7:
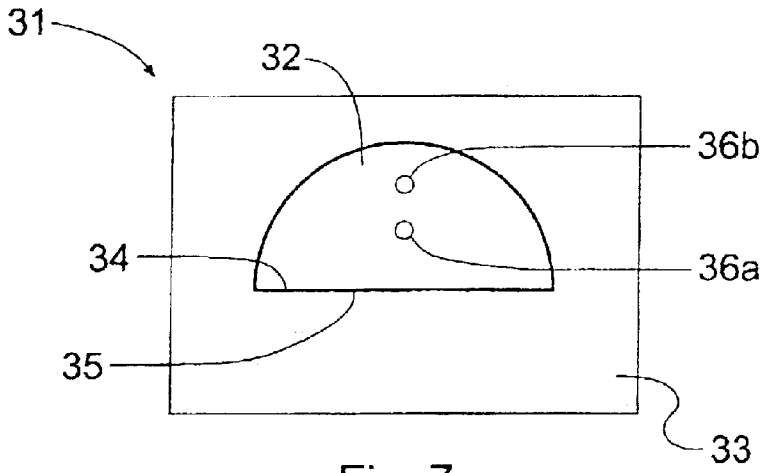
FIGS. 7 and 8 show a semi-cylindrical DRA provided with a conducting wall both without and with extensions.

FIG. 7 shows a DRA 31 formed of a dielectric resonator element 32 shaped as a half-cylinder and mounted on a grounded base plane 33. A face 34 of the element 32 is provided with a conducting wall 35 as shown. Inner and outer elongate probes 36*a*, 36*b* are provided in the element 32.

Figure 8:
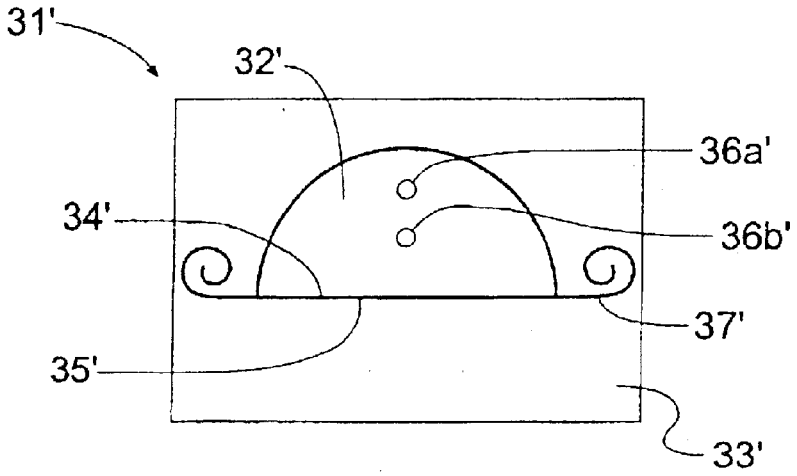

FIG. 8 shows a DRA 31' similar to that of FIG. 7, with a semi-cylindrical dielectric resonator element 32', a grounded base plane 33' and a conducting wall 35' mounted on a face 34' of the element 32'. Inner and outer elongate probes 36*a*', 36*b*' are provided, and the conducting wall 35' is provided with extensions 37' along the length of the element 32', the extensions 37' being curled back away from the face 34'. The extensions 37' help to impede electromagnetic signals which might otherwise creep around the edges of the wall 35' and thus create or contribute to a backlobe.

Figure 9:
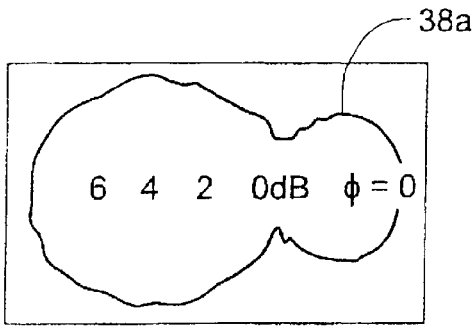
FIGS. 9 and 10 show the radiation patterns generated by the DRA of FIG. 7.
Figure 10:
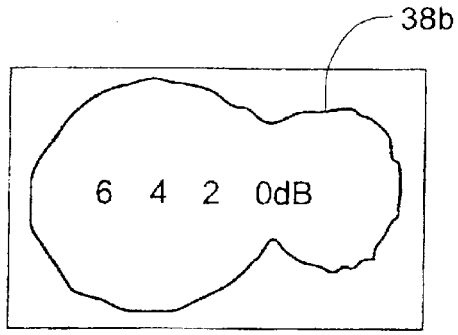
Figure 11:
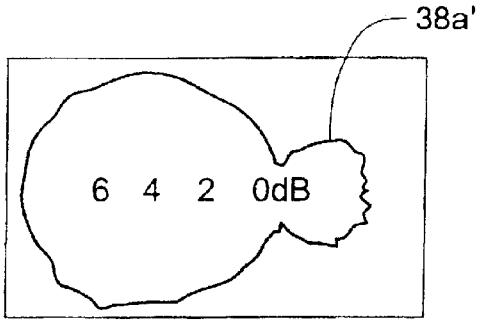
FIGS. 11 and 12 show the radiation patterns generated by the DRA of FIG. 8.
Figure 12:
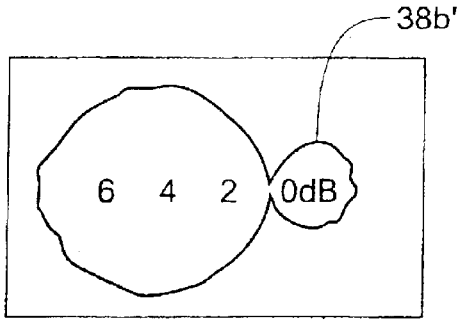

This may be seen clearly in FIGS. 9, 10, 11 and 12, which respectively show the radiation pattern for the DRA of FIG. 7 with the inner probe 36*a* being excited, the DRA of FIG. 7 with the outer probe 36*b* being excited, the DRA of FIG. 8 with the inner probe 36*a*' being excited and the DRA of FIG. 8 with the outer probe 36*b*' being excited. The backlobes 38*a* and 38*b* of FIGS. 9 and 10 are significantly larger than the backlobes 38*a*' and 38*b*' of FIGS. 11 and 12, clearly demonstrating the effectiveness of the extensions 37' in reducing the backlobes. It should be noted that although two probes 36*a*, 36*b* and 36*a*', 36*b*' are provided in each element 32, 32', only one probe at a time is excited in this example.

What is claimed is:

1. A dielectric resonator antenna comprising a dielectric resonator structure and a plurality of feeding mechanisms for transferring energy into and from the dielectric resonator structure, the feeding mechanisms being configured so that different parts of the dielectric resonator structure are activatable independently of each other by way of electronic circuitry, characterized in that the dielectric resonator structure comprises a plurality of individual dielectric resonator elements arranged such that at least one side face of each dielectric resonator element is adjacent to at least one side face of a neighboring dielectric resonator element, and in that each dielectric resonator element is provided with its own feeding mechanism such that the dielectric resonator elements may be independently activated individually or in combination so as to produce at least one incrementally or continuously steerable beam, which may be steered through a predetermined angle.

2. An antenna as claimed in claim 1 wherein a gap is provided between at least two of the adjacent side faces.

3. An antenna as claimed in claim 2, wherein the steerable beam may be steered through a complete 360 degree circle.

4. An antenna as claimed in claim 2, further including electronic circuitry to combine the feeding mechanisms of multiple elements so as to form sum and difference patterns to permit radio direction finding capability of up to 360 degrees.

5. An antenna as claimed in claim 2, further including electronic circuitry to combine the feeding mechanisms of multiple elements to form an amplitude and/or phase comparison radio direction finding capability of up to 360 degrees.

6. An antenna as claimed in claim 2, wherein a single transmitter or receiver is connected to a plurality of elements.

7. An antenna as claimed in claim 2, wherein a plurality of transmitters or receivers are individually connected to a corresponding plurality of elements.

8. An antenna as claimed in claim 2, wherein a single transmitter or receiver is connected to a plurality of non-adjacent elements.

9. An antenna as claimed in claim wherein the adjacent side faces of at least one pair of neighboring elements are separated by an electrically conductive wall which contacts both side faces.

10. An antenna as claimed in claim 9, wherein all the side faces are provided with an electrically conductive wall.

11. An antenna as claimed in claim 9, wherein at least one conductive wall extends beyond the side faces of the elements in a generally radial direction from the longitudinal axis.

12. An antenna as claimed in claim 1, wherein the elements are arranged in a generally circular configuration about a central longitudinal axis such that each element is flanked by two neighboring elements.

13. An antenna as claimed in claim 1, wherein the elements are arranged in a partial generally circular configuration about a longitudinal axis, with all except a first and a last element being flanked by two neighboring elements.

14. An antenna as claimed in claim 1, wherein the elements have cross-sections shaped as sectors of a circle.

15. An antenna as claimed in claim 1, wherein the elements have triangular cross-sections.

16. An antenna as claimed in claim 1, wherein the elements have generally trapezoidal cross-sections.

17. An antenna as claimed in claim 1, wherein all of the elements have the same cross-section.

18. An antenna as claimed in claim 1, wherein the feeding mechanisms takes the form of conductive probes which are contained within or against the dielectric resonator elements, or a combination thereof.

19. An antenna as claimed in claim 18, wherein a predetermined number of the probes within or against the dielectric resonator elements, or a combination thereof, are not connected to the electronic circuitry.

20. An antenna as claimed in claim 19, wherein the probes are unterminated (open circuit).

21. An antenna as claimed in claim 19, wherein the probes are terminated by a load of any impedance, including a short circuit.

22. An antenna as claimed in claim 1, wherein the feeding mechanisms take the form of apertures provided in the grounded substrate.

23. An antenna as claimed in claim 22, wherein the apertures are formed as discontinuities in the grounded substrate underneath the dielectric resonator elements.

24. An antenna as claimed in claim 23, wherein the apertures are generally rectangular in shape.

25. An antenna as claimed in claim 22, wherein a microstrip transmission line is located beneath each aperture to be excited.

26. An antenna as claimed in claim 25, wherein the microstrip transmission line is printed on a side of the substrate remote from the dielectric resonator elements.

27. An antenna as claimed in claim 1, wherein the dielectric resonator elements are formed of a dielectric material having a dielectric constant $k^3 10$.

28. An antenna as claimed in claim 1, wherein the dielectric resonator elements are formed of a dielectric material having a dielectric constant $k^3 50$.

29. An antenna as claimed in claim 1, wherein the dielectric resonator elements are formed of a dielectric material having a dielectric constant $k^3 100$.

30. An antenna as claimed in claim 1, wherein the dielectric resonator elements are formed from a liquid or gel material.

31. An antenna as claimed in claim 1, wherein the dielectric resonator elements are formed from a solid material.

32. An antenna as claimed in claim 1, wherein the dielectric resonator elements are formed from a gaseous material.

33. An antenna as claimed in claim 1, wherein the feeding mechanism comprises at least one monopole feed.

34. An antenna as claimed in claim 33, wherein each dielectric resonator element is associated with a grounded substrate.

35. An antenna as claimed in claim 1, wherein the feeding mechanism comprises at least one dipole feed.

36. An antenna as claimed in claim 1, wherein at least one of the dielectric resonator elements is associated with a grounded substrate and has a feeding mechanism comprising at least one monopole feed, and wherein at least one other of the dielectric resonator elements has a feeding mechanism comprising at least one dipole feed.

* * * * *

UNITED STATES PATENT AND TRADEMARK OFFICE

CERTIFICATE OF CORRECTION

PATENT NO. : 6,816,118 B2
DATED : November 9, 2004
INVENTOR(S) : Kingsley et al.

It is certified that error appears in the above-identified patent and that said Letters Patent is hereby corrected as shown below:

Column 8,
Line 58, after "as claimed in claim" please insert -- 1, -- therein.

Signed and Sealed this

Twenty-third Day of August, 2005

JON W. DUDAS
*Director of the United States Patent and Trademark Office*